US010793397B2

(12) United States Patent
Preziosa

(10) Patent No.: US 10,793,397 B2
(45) Date of Patent: Oct. 6, 2020

(54) GUIDE ASSEMBLIES AND RUNNERS

(71) Applicant: WITTUR HOLDING GMBH, Wiedenzhausen (DE)

(72) Inventor: Massimo Preziosa, Wiedenzhausen (DE)

(73) Assignee: WITTUR HOLDING GMBH, Wiedenzhausen (DE)

( * ) Notice: Subject to any disclaimer, the term of this patent is extended or adjusted under 35 U.S.C. 154(b) by 350 days.

(21) Appl. No.: 15/776,411

(22) PCT Filed: Nov. 7, 2016

(86) PCT No.: PCT/IB2016/056689
§ 371 (c)(1),
(2) Date: May 16, 2018

(87) PCT Pub. No.: WO2017/085585
PCT Pub. Date: May 26, 2017

(65) Prior Publication Data

US 2018/0297818 A1 Oct. 18, 2018

(30) Foreign Application Priority Data

Nov. 17, 2015 (IT) ..... 102015000073090

(51) Int. Cl.
*B66B 13/30* (2006.01)

(52) U.S. Cl.
CPC ..... *B66B 13/301* (2013.01); *E05Y 2900/104* (2013.01)

(58) Field of Classification Search
CPC ..... B66B 13/301; B66B 13/30; B66B 13/308; E05Y 2900/104
See application file for complete search history.

(56) References Cited

U.S. PATENT DOCUMENTS 3,195,171 A * 7/1965 Klein ..... E05D 15/0656 16/90
5,174,675 A * 12/1992 Martin ..... B66B 13/303 187/333

(Continued)

FOREIGN PATENT DOCUMENTS

JP 2004099265 A 4/2004
JP 2005082315 A 3/2005
JP 2006131314 A 5/2006

*Primary Examiner* — Michael A Riegelman
(74) *Attorney, Agent, or Firm* — Merchant & Gould P.C.

(57) ABSTRACT

Guide assemblies are provided which include a translation guide, a door leaf for a lift, movable along the guide and comprising at least one support element placed at one end of the door leaf, at least one runner housed slidably in the translation guide and defining one or more connection seats to the support element, wherein the connection seat/s and the support element can be coupled with at least two different orientations of the runner with respect to the door leaf. For each orientation, the runner delimits at least a different friction surface with respect to the translation guide, the friction surfaces being non-equidistant from the support element so that the relative position between the door leaf and the translation guide can be changed by different orientations of the runner. The invention further relates to runners usable in a guide assembly.

15 Claims, 4 Drawing Sheets

(56) References Cited

U.S. PATENT DOCUMENTS

| | | | | |
|---|---|---|---|---|
| 5,706,913 | A * | 1/1998 | Rivera | B66B 13/301 187/334 |
| 6,684,573 | B2 * | 2/2004 | Heath | B66B 13/301 187/334 |
| 2006/0191749 | A1 * | 8/2006 | Sasaki | B66B 13/301 187/391 |
| 2008/0271960 | A1 * | 11/2008 | Michaels | B66B 13/30 187/335 |
| 2012/0151841 | A1 * | 6/2012 | Rahardjo | B66B 13/08 49/426 |
| 2017/0297871 | A1 * | 10/2017 | Zhang | B66B 13/301 |
| 2018/0105398 | A1 * | 4/2018 | Giorgioni | B66B 13/26 |
| 2018/0297818 | A1 * | 10/2018 | Preziosa | B66B 13/301 |
| 2019/0177128 | A1 * | 6/2019 | Ruan | B66B 13/303 |
| 2019/0292017 | A1 * | 9/2019 | Hamon | E05D 15/0656 |

* cited by examiner

GUIDE ASSEMBLIES AND RUNNERS

CROSS-REFERENCE TO RELATED APPLICATIONS

This application is a National Phase Application of PCT International Application No. PCT/IB2016/056689, International Filing Date, Nov. 7, 2016, claiming priority to Italian Patent Application No. 102015000073090, filed Nov. 17, 2015, each of which is hereby incorporated by reference in its entirety.

FIELD OF THE INVENTION

The present invention relates to a guide assembly for a lift door.

BACKGROUND OF THE INVENTION

It is known that the sills of lifts in elevator systems, and the respective sliding doors, can be very different from a construction point of view.

The materials of the sills or doors, the intended use of the lift (for civil or industrial use) and/or specific construction contingencies can influence the choices or requirements of the installers of such systems.

However, for manufacturers of the relevant components, this translates into high production and logistics costs as a result of the differences imposed by the market.

The present invention lies within this context, proposing to provide an assembly able to overcome the aforesaid drawbacks and, more specifically, suitable to provide a single runner designed to combine in a single component a series of construction requirements different from each other.

SUMMARY OF THE INVENTION

Such objective may be achieved by a guide assembly comprising: a translation guide, a door leaf for a lift, movable along the translation guide and comprising at least a support element placed at one end of said leaf; at least one runner, slidably housed in the translation guide and defining one or more connection seats to the support element, wherein said seat/s and said element can be coupled with at least two different orientations of the runner with respect to the door leaf; wherein, for each orientation, the runner delimits at least a different friction surface with respect to the translation guide, the friction surfaces being non-equidistant from the support element so that the relative position between the door leaf and the translation guide can be changed by means of the different orientations of said runner.

Such objective also may be achieved by a runner usable in a guide assembly (e.g. in the guide assembly as previously defined), said runner identifying one or more connection seats to the support element, wherein said seat/s and said element are coupled with at least two different orientations of the runner with respect to the door leaf wherein, for each orientation, the runner delimits at least a different friction surface from the translation guide, the friction surfaces being non-equidistant from the at least one connection seat for the support element so that the relative position between the door leaf and the translation guide can be changed by means of the different orientations of said runner.

Other exemplary embodiments are also described and claimed herein.

The present invention will now be described in detail with reference to the attached drawings.

DETAILED DESCRIPTION

Figure 1:
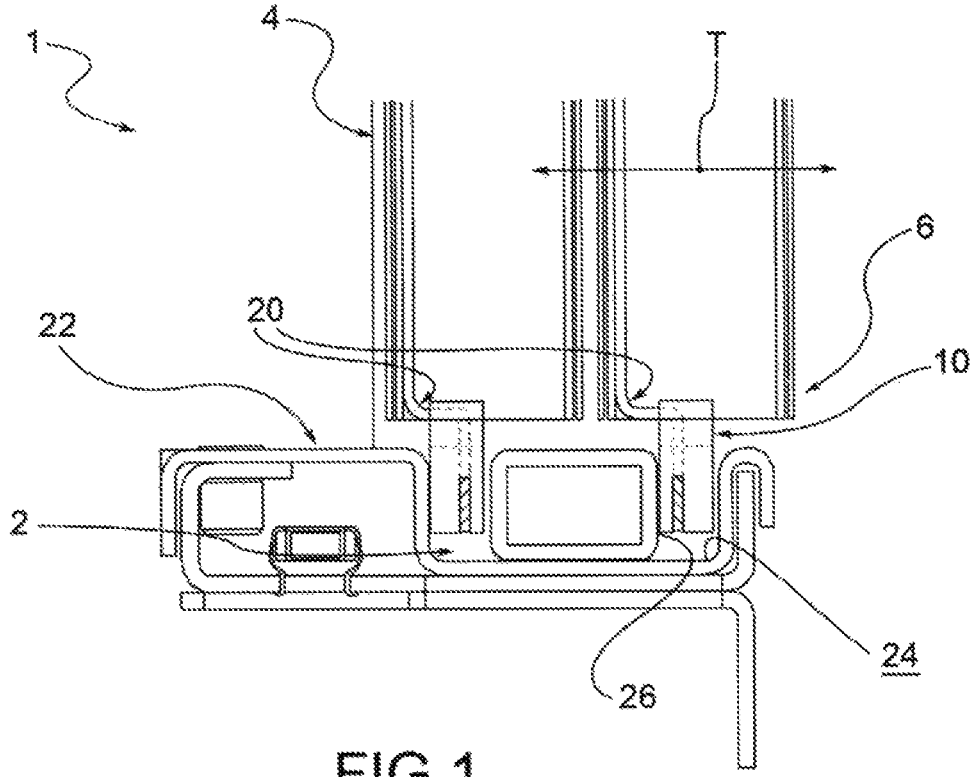
FIGS. 1 and 2 show two cross-sectional views of an assembly according to two embodiments of the invention, in a cross-section plane substantially orthogonal to the main extension of the translation guide.
Figure 2:
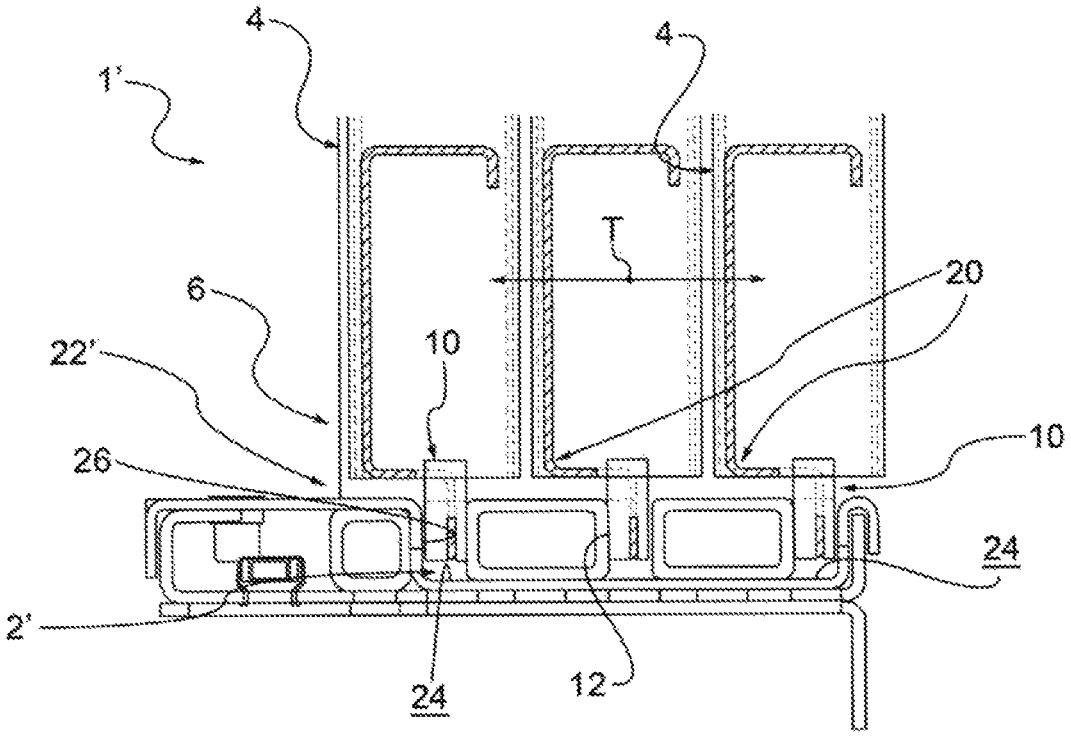

With reference to the aforementioned drawings, reference numerals 1, 1' globally denote a guide assembly comprising a translation guide 2, 2', a door leaf 4 for a lift and at least one runner 10.

In the embodiments shown in the drawings, such assembly is illustrated respectively with two or three leaves. However, such assembly could comprise a greater or smaller number of leaves than shown.

The door leaf 4 is movable along the translation guide 2, 2' and comprises at least one support element 20 placed at one end 6 of the leaf, such end being preferably a lower end (in the vertical direction).

Preferably, the support element 20 comprises one or more support brackets for the runner 10, said bracket (or plurality thereof) being more precisely mounted or welded to the lower end 6.

According to one variant, the support bracket is mounted or welded so as to protrude towards the translation guide 2, 2'.

The runner 10 is slidably housed in the translation guide 2, 2' and defines one or more connection seats 8, 8' to the support element 20.

Specifically, the runner 10 is slidably housed in a longitudinal groove 24 defined by the aforesaid guide 2, 2.

According to one advantageous variant, the runner 10 is made at least in part (for example completely) of a polymeric material.

Figure 3:
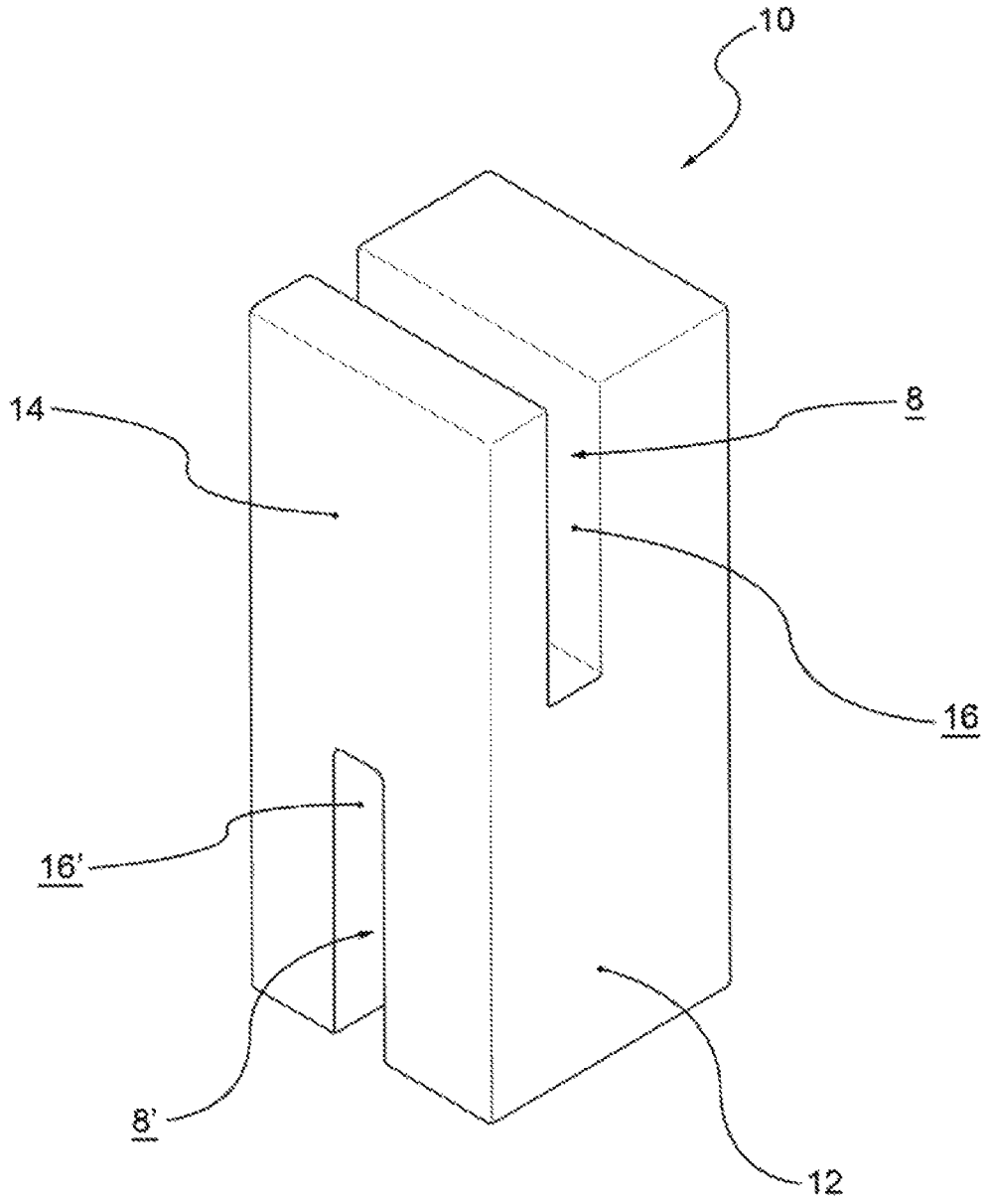
FIGS. 3 to 8 respectively represent a perspective view, two side views, a side view in cross-section, a view from above and a view from below of a runner according to embodiments of the present invention, the cross-section in FIG. 6 being made along the plane VI-VI indicated in FIG. 5.
Figures 4, 5, 6:
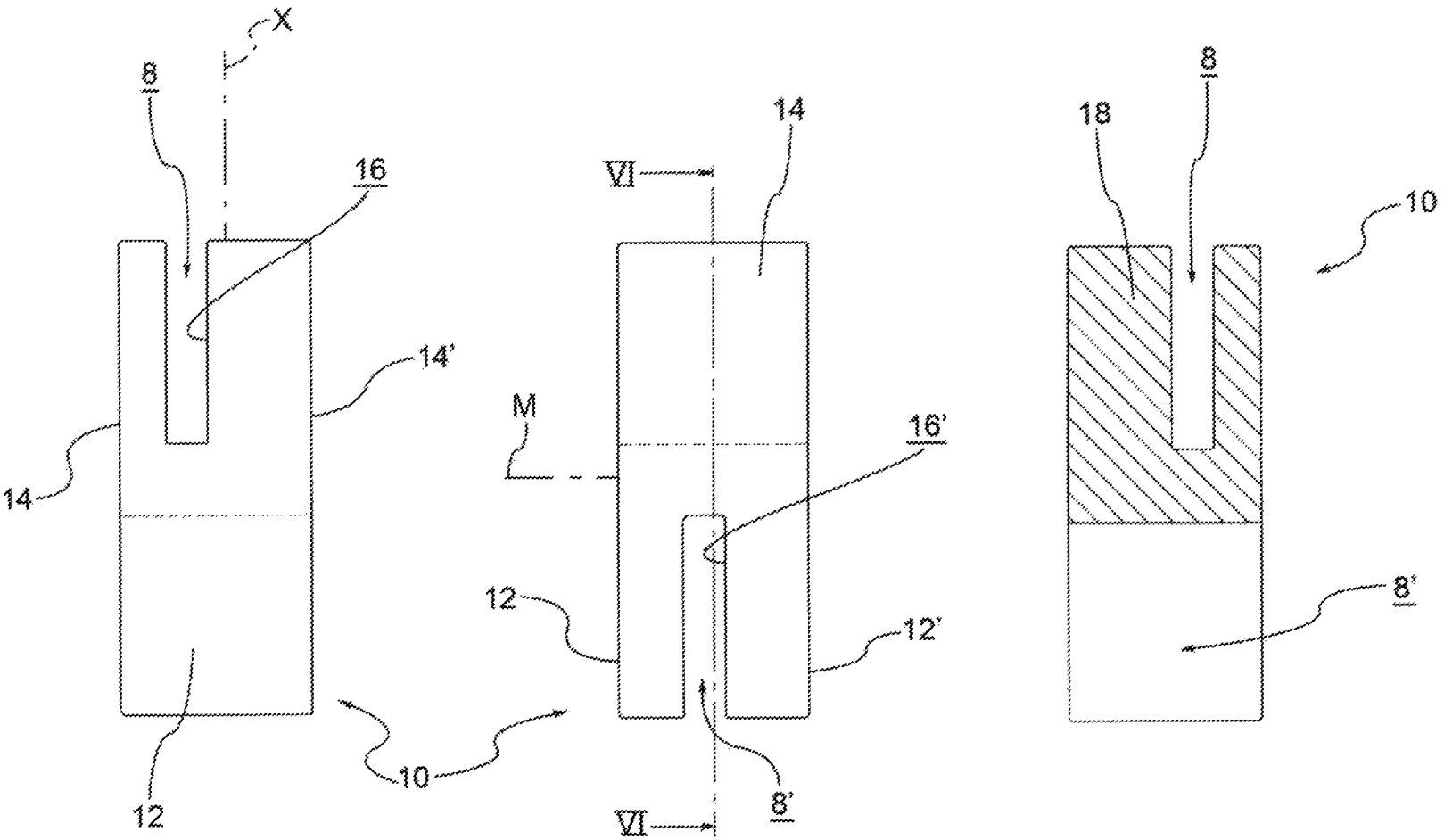

In the variant shown in FIG. 3, the runner 10 is substantially in the shape of a parallelepiped, in particular in the form of a rectangular parallelepiped.

The aforesaid connection seat (or the aforesaid plurality of connection seats) and the lower end can be coupled with at least two different orientations of the runner 10 with respect to the door leaf 4.

In other words, the runner 10 and the door leaf are shaped so as to present a reversible connection or mounting, variable depending on the spatial orientation of the runner 10.

Innovatively, for each orientation, the runner 10 delimits at least a different friction surface 12, 12', 14, 14' with respect to the translation guide 2, 2' where the friction surfaces 12, 12', 14, 14' are non-equidistant from the support element 20 so that the relative position between the door leaf 4 and the translation guide 2, 2' can be changed by means of the different orientations of said runner 10.

It follows that, since the runner 10 delimits different friction surfaces and such surfaces are at a different distance from the support element 20 (and therefore from the lower end), the door leaf 4 can assume different sliding positions with respect to the translation guide.

Preferably, the friction surfaces 12, 12', 14, 14' are in abutment with at least a side wall 26 defining part of the aforesaid longitudinal groove 24.

The distance between each friction surface 12; 12'; 14; 14' and the support element 20 is preferably calibrated in order to adjust the location of the door leaf 4 in a transversal direction T to the main extension of the translation guide 2, 2'.

According to a first embodiment, the adjustment is made with a range of between 0.5-6.0 millimetres.

According to a second embodiment, the adjustment is made with a pitch of about 0.5-1.5 millimetres, preferably 0.8-1.2 mm, for example about 1.0 millimetre.

According to an embodiment, the support element 20 and at least one connection seat 8, 8' of the runner 10 are shaped to be connectable to each other with a first orientation and with a second orientation. In the second orientation the runner 10 is rotated with respect to the support element 20 by at least 90° compared to the first orientation, for example approximately 180°.

For example, such rotation of at least 90° could take place around a vertical axis, or around a main extension axis X of the runner.

According to a further variant, the runner 10 identifies at least a pair of non-coinciding connection seats 8, 8' accessible through opposite ends of such runner 10, for example an upper and lower end according to the arrangement shown in FIG. 3.

According to the latter variant, the connection between the lower end 6 and one 8 or other 8' connection seat of the runner 10 occurs preferably at least through an up-down reversal of said runner 10.

For example, such reversal could take place at least around a median axis M of the runner 10.

According to an advantageous variant, the connection seat 8, 8' or the plurality thereof comprises a recess 16, 16', which extends at least partly into the body 18 of the runner 10.

Preferably, at least part of the support element 20 or the support bracket (where provided) is suitable for being inserted inside such recess 16, 16'.

Figure 7:
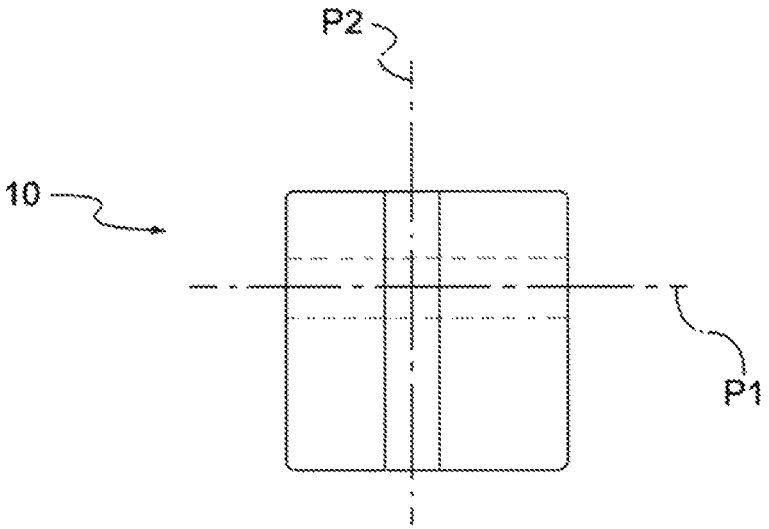
Figure 8:
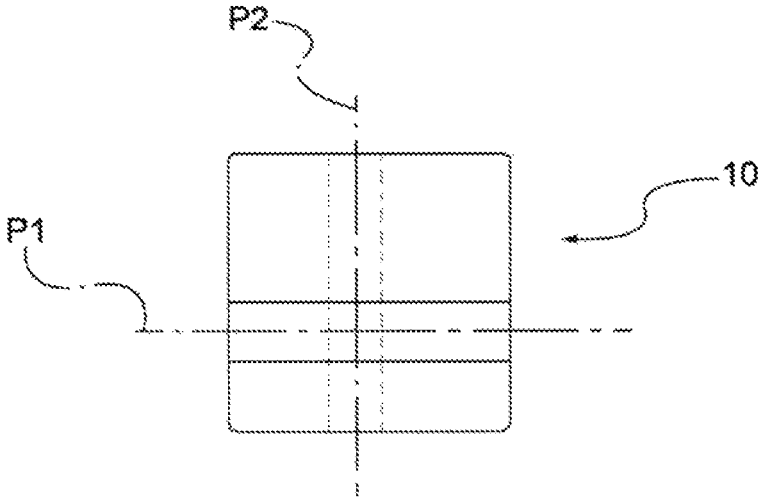

Referring for example to FIG. 7 or 8, the pair of recesses 16, 16' could extend in intersecting planes P1, P2, for example at about 90°.

According to one embodiment, the translation guide 2, 2' could be integrated at least in part inside a walkable sill 22, 22' of an elevator car or a landing door.

According to different embodiments, said walkable sill could be selected between an aluminium sill, an iron sill or a stainless steel sill.

According to a preferred embodiment, the assembly 1 could comprise a car or landing upright, with respect to which the door leaf 4 is movable/slidable. The maximum space defined between a front surface of said leaf 4 and said upright is preferably equal to or smaller than about 3 mm.

The present invention further relates to a runner 10 usable in a guide assembly, preferably in an assembly according to any of the previous embodiments.

Such runner 10 identifies one or more connection seats 8, 8' to the support element 20, where said seat/s and such end are coupled with at least two different orientations of the runner 10 with respect to the leaf 4.

For each orientation, the runner 10 delimits at least a different friction surface 12, 12', 14, 14' from the translation guide 2, 2', the friction surfaces 12, 12', 14, 14' being non-equidistant from the at least one connection seat 8, 8' for the support element 20 so that the relative position between the door leaf 4 and the translation guide 2, 2' can be changed by means of the different orientations of said runner 10.

Innovatively, the aforesaid assembly and the aforesaid runner make it possible to resolve the problems relative to the prior art.

More precisely, the runner has been designed so that a single component can resolve a multitude of possible adjustments of a leaf with respect to a guide, merely by means of a different orientation of the runner with respect to the leaf.

Advantageously, the aforesaid runner is made in one piece together with the necessary connection seat/s, so that it has a very low production cost.

Logistics costs are also markedly lower than traditional systems, given the storage and transport of a single, versatile component.

Advantageously, the assembly and the runner according to the present invention make it possible to achieve excellent assembly tolerances in a variety of different assembly configurations.

Advantageously, the assembly and the runner according to the present invention make it possible to comply with all applicable safety regulations.

A person skilled in the art may make variations or replacements of elements with others functionally equivalent to the aforementioned embodiments of the assembly and of the runner so as to satisfy specific requirements.

Such embodiments also should be considered to be within the scope of protection as described and claimed herein.

In addition, each variant described as belonging to a possible embodiment may be realised independently of the other embodiments described.

The invention claimed is:

1. A guide assembly (1, 1') comprising:

a translation guide (2, 2');

a door leaf (4) for a lift, movable along the translation guide (2, 2') and comprising at least a support element (20) placed at one end (6) of said leaf;

at least one runner (10) slidably housed in the translation guide (2, 2') and defining one or more connection seats (8, 8') to the support element (20), wherein said seat/s and said element can be coupled with at least two different orientations of the runner (10) with respect to the door leaf (4);

wherein, for each orientation, the runner (10) delimits at least a different friction surface (12, 12', 14, 14') with respect to the translation guide (2, 2'), the friction surfaces (12, 12', 14, 14') being non-equidistant from the support element (20) so that the relative position between the door leaf (4) and the translation guide (2, 2') can be changed by different orientations of said runner (10).

2. The assembly of claim 1, wherein the distance between each friction surface (12; 12'; 14; 14') and the support element (20) is calibrated in order to adjust the location of the door leaf (4) in a transversal direction (T) to a main extension of the translation guide (2, 2').

3. The assembly of claim 2, wherein said adjustment is made with an excursion comprised between 0.5-6.0 millimetres, with a pitch of approximately 0.5-1.5 millimetres.

4. The assembly of claim 1, wherein the support element (20) and at least one connection seat (8, 8') of the runner (10) are shaped to be connectable to each other with a first orientation, and with a second orientation in which the runner (10) is rotated with respect to the support element (20) by at least 90° to the first orientation, for example approximately 180°.

5. The assembly of claim 4, wherein said rotation of at least 90° takes place around a main extension axis (X) of the runner, and/or wherein said reversal occurs at least around a median axis (M) of the runner (10).

6. The assembly of claim 1, wherein the runner (10) identifies at least a pair of non-coinciding connection seats (8, 8') accessible through opposite ends of said runner (10).

7. The assembly of claim 6, wherein the connection between the support element (20) and one (8) or other (8') connection seat of the runner (10) occurs at least through an up-down reversal of said runner (10).

8. The assembly of claim 1, wherein the connection seat (8, 8') or a plurality thereof comprises a recess (16, 16'), which extends at least partly into a body (18) of said runner (10) and inside which at least part of the support element (20) is insertable.

9. The assembly of claim 8, wherein the pair of recesses (16, 16') extend on mutually intersecting planes (P1, P2).

10. The assembly of claim 1, wherein the support element (20) comprises at least one or more support brackets for the runner (10), said bracket being mounted or welded to the lower end (6), in a manner projecting towards the translation guide (2, 2').

11. The assembly of claim 1, wherein the runner (10) comprises a polymeric material.

12. The assembly of claim 1, wherein the runner (10) is substantially in a rectangular parallelepiped shape.

13. The assembly of claim 1, wherein the translation guide (2, 2') is integrated at least in part inside a walkable sill (22, 22') of an elevator car or a landing door, said walkable sill being selected between an aluminium sill, an iron sill or a stainless steel sill.

14. The assembly of claim 1, comprising a car or landing upright, with respect to which the door leaf (4) is movable, the maximum space defined between a front surface of said leaf (4) and said upright being equal to or smaller than 3 millimetres.

15. A runner (10) usable in a guide assembly;

wherein said guide assembly (1, 1') comprises a translation guide (2, 2'), a door leaf (4) for a lift, movable along the translation guide (2, 2') and comprising at least one support element (20) placed at one end (6) of said leaf, and at least one of said runners being housed slidably in the translation guide (2, 2');

wherein the runner (10) identifies one or more connection seats (8, 8') to the support element (20), wherein said seat/s and said element are coupled with at least two different orientations of the runner (10) with respect to the door leaf (4);

wherein, for each orientation, the runner (10) delimits at least a different friction surface (12, 12 ‘, 14, 14') from the translation guide (2, 2'), the friction surfaces (12, 12', 14, 14') being non-equidistant from the at least one connection seat (8, 8') for the support element (20) so that the relative position between the door leaf (4) and the translation guide (2, 2') can be changed by different orientations of said runner (10).

* * * * *